US009932778B2

(12) United States Patent
Obrejanu

(10) Patent No.: US 9,932,778 B2
(45) Date of Patent: Apr. 3, 2018

(54) DOWNHOLE TUBING SWIVELS AND RELATED METHODS

(71) Applicant: Premium Artificial Lift Systems Ltd., Calgary (CA)

(72) Inventor: Marcel Obrejanu, Calgary (CA)

(73) Assignee: Premium Artificial Lift Systems Ltd., Calgary (CA)

( * ) Notice: Subject to any disclaimer, the term of this patent is extended or adjusted under 35 U.S.C. 154(b) by 329 days.

(21) Appl. No.: 14/561,853

(22) Filed: Dec. 5, 2014

(65) Prior Publication Data

US 2016/0160576 A1 Jun. 9, 2016

(51) Int. Cl.

| | |
|---|---|
| ***E21B 17/05*** | (2006.01) |
| ***E21B 23/01*** | (2006.01) |
| ***E21B 21/02*** | (2006.01) |
| ***E21B 17/10*** | (2006.01) |
| ***E21B 19/16*** | (2006.01) |
| ***E21B 33/04*** | (2006.01) |

(52) U.S. Cl.
CPC ..... *E21B 17/05* (2013.01); *E21B 17/1085* (2013.01); *E21B 19/16* (2013.01); *E21B 23/01* (2013.01); *E21B 33/0415* (2013.01)

(58) Field of Classification Search
CPC ..... E21B 17/021; E21B 17/05; E21B 23/01; E21B 21/02; E21B 33/0415
See application file for complete search history.

(56) References Cited

U.S. PATENT DOCUMENTS

| | | | | |
|---|---|---|---|---|
| 3,100,538 A | | 8/1963 | Sanders | |
| 3,158,201 A | | 11/1964 | Springer | |
| 3,433,301 A | | 3/1969 | McEver | |
| 3,494,417 A | | 2/1970 | Fredd | |
| 3,552,492 A | * | 1/1971 | Mullins | E21B 33/1292 166/237 |
| 4,030,546 A | | 6/1977 | Rogers et al. | |
| 4,051,899 A | | 10/1977 | Fredd | |
| 4,127,168 A | | 11/1978 | Hanson et al. | |

(Continued)

OTHER PUBLICATIONS

Rodec™ Specification, R&M Energy Systems, printed from Wayback Machine internet archive for Aug. 7, 2007, p. 9.

(Continued)

*Primary Examiner* — Cathleen Hutchins
(74) *Attorney, Agent, or Firm* — Wolf, Greenfield & Sacks, P.C.

(57) ABSTRACT

A top sub, for connection to a tubing string of a production well, has a first engagement structure, and a mandrel has a second engagement structure. A coupling engages the first and second engagement structures. A housing covers an internal space of the tubing swivel, in which the coupling is located. The coupling includes a first coupling structure having a shape complementary to a shape of the first engagement structure and a second coupling structure having a shape complementary to a shape of the second engagement structure. One of (i) the first engagement structure and the first coupling structure and (ii) the second engagement structure and the second coupling structure has a clutch mechanism to enable the top sub to be rotated in a first direction relative to the mandrel and to rotate the mandrel with rotation of the top sub in a second direction opposite the first direction.

22 Claims, 5 Drawing Sheets

(56) References Cited

U.S. PATENT DOCUMENTS

| | | | | |
|---|---|---|---|---|
| 4,564,068 | A | 1/1986 | Bauhj | |
| 4,577,685 | A | 3/1986 | Eatwell | |
| 4,593,765 | A | 6/1986 | Greenlee | |
| 4,625,798 | A | 12/1986 | Bayh | |
| 4,658,895 | A | 4/1987 | Brisco | |
| 4,726,425 | A | 2/1988 | Smith | |
| 4,749,341 | A | 6/1988 | Bayh | |
| 4,913,239 | A | 4/1990 | Bayh | |
| 5,642,782 | A | 7/1997 | Grimshaw et al. | |
| 5,836,396 | A | 11/1998 | Norman et al. | |
| 6,131,663 | A | 10/2000 | Henley et al. | |
| 6,467,547 | B2 | 10/2002 | Maguire et al. | |
| 7,011,162 | B2 | 3/2006 | Maguire et al. | |
| 7,178,611 | B2 * | 2/2007 | Zupanick | E21B 17/04 175/107 |
| 2004/0094309 | A1 | 5/2004 | Maguire | |
| 2004/0144571 | A1 * | 7/2004 | Boyd | E21B 17/05 175/321 |
| 2009/0114400 | A1 | 5/2009 | Obrejanu | |

OTHER PUBLICATIONS

Rodec™Slimline Tubing Swivel, R&M Energy Systems, printed from Wayback Machine internet archive for Aug. 7, 2007, p. 1.

* cited by examiner

DOWNHOLE TUBING SWIVELS AND RELATED METHODS

FIELD OF THE INVENTION

This invention relates generally to downhole equipment for production wells and, in particular, to downhole tubing swivels.

BACKGROUND

Tubing swivels are used in production wells to reduce the effects of tubing wear at a point of contact between a sucker rod string and an inside surface of a production tubing string. A tubing rotator that is installed at the surface, as part of a wellhead, slowly turns the tubing string from the surface all the way to the tubing swivel installed above the downhole pump. Tubing rotators typically turn the tubing string to the right (right hand rotation). Rotation of the tubing string changes the point of contact and wear is distributed around the inside diameter of the tubing string.

SUMMARY

In an embodiment, a downhole tubing swivel includes: a top sub for connection to a tubing string of a production well, the top sub having a first engagement structure; a mandrel having a second engagement structure; a coupling to engage both the first engagement structure and the second engagement structure; a housing to cover an internal space of the tubing swivel, between the housing, the top sub, and the mandrel and including the coupling, and to couple the top sub to the mandrel. The coupling includes a first coupling structure having a shape complementary to a shape of the first engagement structure and a second coupling structure having a shape complementary to a shape of the second engagement structure, one of (i) the first engagement structure and the first coupling structure and (ii) the second engagement structure and the second coupling structure including a clutch mechanism to enable the top sub to be rotated in a first direction relative to the mandrel and to rotate the mandrel with rotation of the top sub in a second direction opposite the first direction.

The clutch mechanism could include a ratchet mechanism, in the form of complementary inclined surfaces of the one of (i) the first engagement structure and the first coupling structure and (ii) the second engagement structure and the second coupling structure.

The other of (i) the first engagement structure and the first coupling structure and (ii) the second engagement structure and the second coupling structure could include complementary lugs.

In an embodiment, the coupling has a hollow cylindrical body to receive a portion of the mandrel. The top sub could also have a hollow cylindrical body, in which case the portion of the mandrel could be positioned concentrically inside the coupling and the hollow cylindrical body of the top sub, with the coupling and the hollow cylindrical body of the top sub being axially adjacent each other along the portion of the mandrel.

As noted above, the clutch mechanism could include a ratchet mechanism. In one embodiment, the ratchet mechanism includes complementary inclined surfaces of the second engagement structure and the second coupling structure, the hollow cylindrical body of the top sub has a first internal circumferential shoulder, and the coupling includes a second internal circumferential shoulder. The tubing swivel then further includes a spring between the first internal circumferential shoulder of the top sub and the second internal circumferential shoulder of the coupling, to bias the coupling toward the second engagement structure.

In another embodiment, the clutch mechanism includes complementary inclined surfaces of the first engagement structure and the first coupling structure, the mandrel includes an external circumferential shoulder, the coupling includes an internal circumferential shoulder, and the tubing swivel further includes a spring between the external circumferential shoulder of the mandrel and the internal circumferential shoulder of the coupling, to bias the coupling toward the first engagement structure.

The tubing swivel could also include seals to seal the internal space of the tubing swivel from the production well.

The tubing swivel, in an embodiment, also includes one or more fasteners to attach the housing to one of the top sub and the mandrel, and one or more shear fasteners to attach the housing to the other of the top sub and the mandrel. The one or more shear fasteners have lower strength than the one or more fasteners, to enable rotation of the mandrel with the top sub in the first direction with application of a torque in the first direction up to a shear torque of the one or more shear fasteners and to enable the top sub to be rotated in the first direction relative to the mandrel after a torque greater than the shear torque has been applied to the mandrel by the top sub.

With this arrangement, a portion of the mandrel could include an external circumferential shoulder and one or more grooves to receive the one or more shear fasteners, with the external circumferential shoulder being axially spaced from the one or more grooves along the mandrel in a direction toward the top sub. The housing could include a hollow cylindrical body to receive the portion of the mandrel, the coupling, and a portion of the top sub, and could also include one or more bores to receive the one or more shear fasteners, and an internal circumferential shoulder to engage the mandrel between the external circumferential shoulder and the one or more grooves in the mandrel. The grooves extend axially along the mandrel beyond an end of the housing in a direction away from the top sub in an embodiment.

A portion of the top sub could instead include an external circumferential shoulder and one or more grooves to receive the one or more shear fasteners, with the external circumferential shoulder being axially spaced from the one or more grooves along the top sub in a direction toward the mandrel. The housing could include a hollow cylindrical body to receive a portion of the mandrel, the coupling, and the portion of the top sub, and could also include one or more bores to receive the one or more shear fasteners, and an internal circumferential shoulder to engage the top sub between the external circumferential shoulder and the one or more grooves in the top sub. The grooves extend axially along the top sub beyond an end of the housing in a direction away from the mandrel in an embodiment.

The one or more shear fasteners enable rotation of the mandrel with the top sub in the first direction, to set an anchor coupled to the mandrel for example, and in this case the clutch mechanism enables the top sub to rotate the mandrel with rotation of the top sub in the second direction to release the anchor.

The tubing swivel, in an embodiment, includes one or more fasteners to attach the housing to one of the top sub and the mandrel, and one or more shear fasteners to attach the top sub to the mandrel. As noted above, the one or more shear fasteners have lower strength than the one or more fasteners, to enable rotation of the mandrel with the top sub in the first direction with application of a torque in the first direction up to a shear torque of the one or more shear fasteners and to enable the top sub to be rotated in the first direction relative to the mandrel after a torque greater than the shear torque has been applied to the mandrel by the top sub.

The tubing swivel could be implemented, for example, in a production well completion system, which could also include the tubing string connected to the top sub, and downhole equipment that includes an anchor coupled to the mandrel.

A method involves connecting a tubing swivel to a tubing string of a production well. The tubing swivel includes a top sub for connection to the tubing string. The top sub includes a first engagement structure, a mandrel that includes a second engagement structure, a coupling, and a housing attached to one of the top sub and the mandrel by one or more fasteners and attached to the other of the top sub and the mandrel by one or more shear fasteners. The coupling is to engage both the first engagement structure and the second engagement structure, and includes a first coupling structure having a shape complementary to a shape of the first engagement structure and a second coupling structure having a shape complementary to a shape of the second engagement structure. One of (i) the first engagement structure and the first coupling structure and (ii) the second engagement structure and the second coupling structure include a clutch mechanism to enable the top sub to be rotated in a first direction relative to the mandrel and to rotate the mandrel with rotation of the top sub in a second direction opposite the first direction. The method also involves connecting an anchor to the mandrel, running the tubing string into the production well, rotating the tubing string in the first direction to rotate the top sub, the housing, and the mandrel to set the anchor at a downhole position in the production well, applying a torque greater than a shear torque of the one or more shear fasteners in the first direction to shear the one or more shear fasteners and allow the top sub to be rotated in the first direction relative to the mandrel, and rotating the tubing string in the second direction to release the anchor.

Such a method could also include retracting the tubing string to a surface of the production well, replacing the one or more shear fasteners to attach the housing to the other of the top sub and the mandrel, running the tubing string into the production well, and rotating the tubing string in the first direction to rotate the top sub, the housing, and the mandrel to set the anchor at a new downhole position in the production well.

Another embodiment involves providing a top sub for connection to a tubing string of a production well, with the top sub including a first engagement structure; providing a mandrel including a second engagement structure; providing a coupling to engage both the first engagement structure and the second engagement structure; and providing a housing to cover an internal space of the tubing swivel, between the housing, the top sub, and the mandrel and including the coupling, and to couple the top sub to the mandrel. The coupling includes a first coupling structure having a shape complementary to a shape of the first engagement structure and a second coupling structure having a shape complementary to a shape of the second engagement structure. One of (i) the first engagement structure and the first coupling structure and (ii) the second engagement structure and the second coupling structure includes a clutch mechanism to enable the top sub to be rotated in a first direction relative to the mandrel and to rotate the mandrel with rotation of the top sub in a second direction opposite the first direction.

The method may also involve arranging the mandrel, the coupling, the top sub, and the housing concentrically, with a portion of the mandrel inside the coupling and a portion of the top sub, with the coupling and the top sub axially adjacent each other along the portion of the mandrel, and with the housing outside the top sub, the mandrel, and the coupling; attaching the housing to one of (a) the top sub and (b) the mandrel with one or more fasteners; and attaching the housing to the other of (a) the top sub and (b) the mandrel with one or more shear fasteners. The one or more shear fasteners have lower strength than the one or more fasteners, to enable rotation of the mandrel with the top sub in the first direction with application of a torque in the first direction up to a shear torque of the one or more shear fasteners and to enable the top sub to be rotated in the first direction relative to the mandrel after a torque greater than the shear torque has been applied to the mandrel by the top sub.

In some embodiments, a method could also involve one or more of: installing one or more seals to seal the housing against the top sub; installing one or more seals to seal the housing against the mandrel; and installing one or more seals to seal the top sub against the mandrel.

Other aspects and features of embodiments of the present disclosure will become apparent to those ordinarily skilled in the art upon review of the following description.

BRIEF DESCRIPTION OF THE DRAWINGS

Examples of embodiments of the invention will now be described in greater detail with reference to the accompanying drawings.

DETAILED DESCRIPTION

Figure 1:
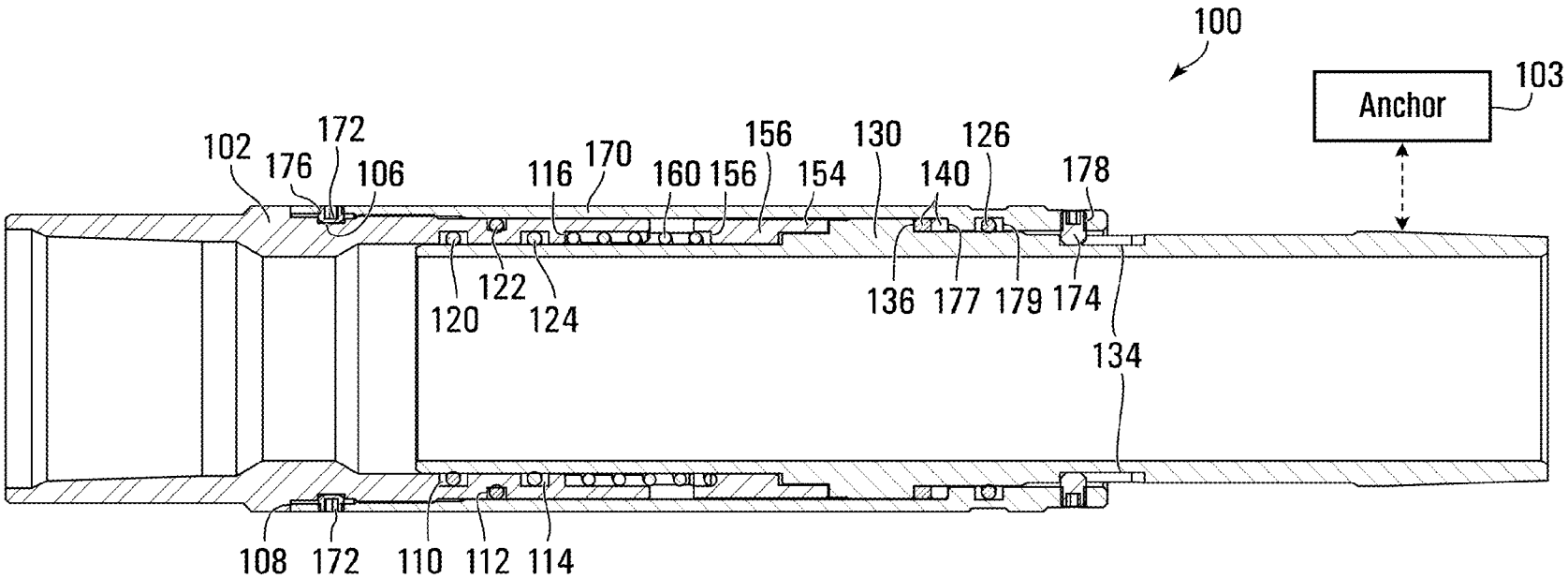
FIG. 1 shows a cross-sectional view of an example tubing swivel coupled to an anchor.
Figure 2:
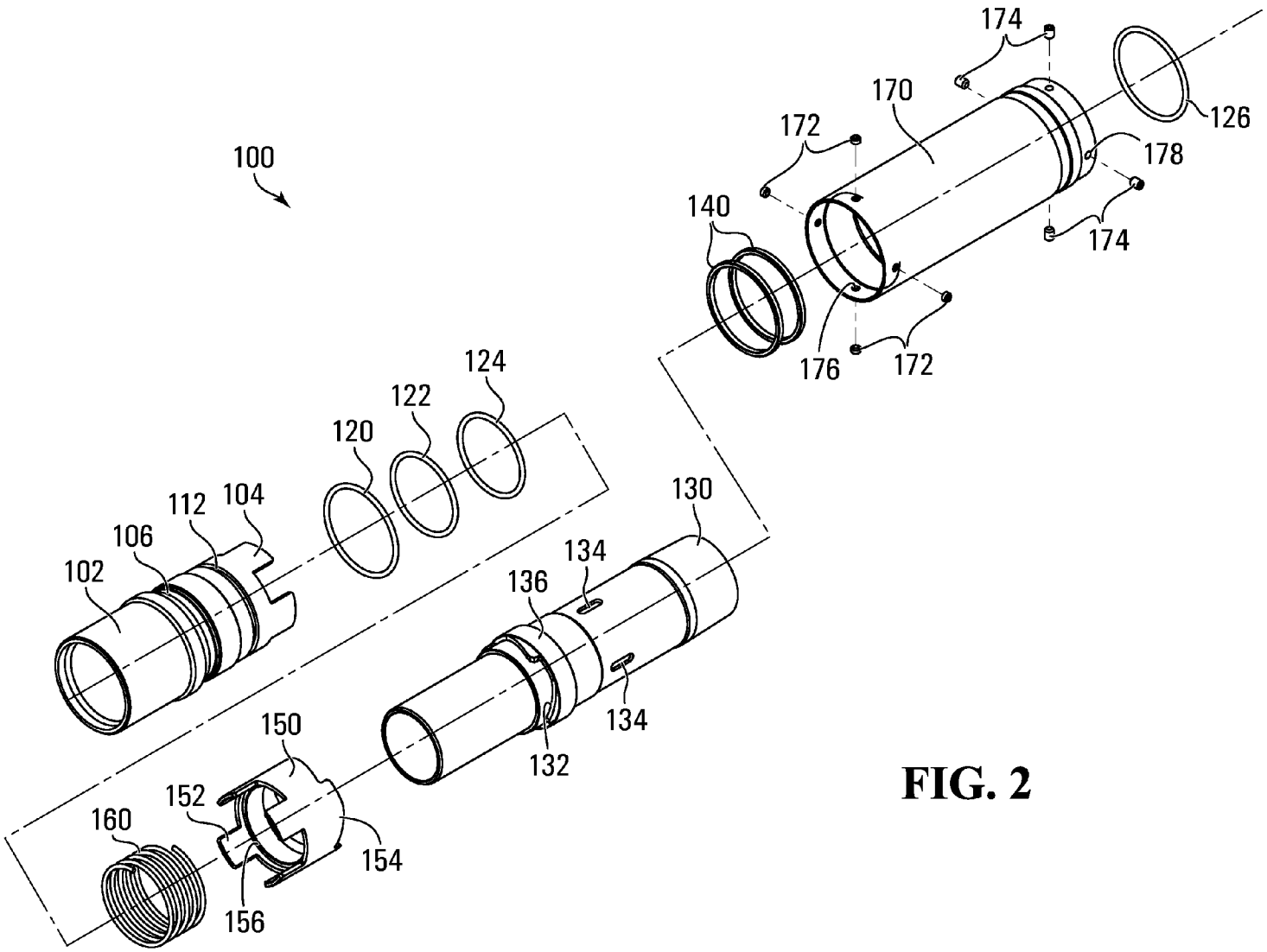
FIG. 2 is an exploded view of the example tubing swivel of FIG. 1.

FIG. 1 shows a cross-sectional view of an example tubing swivel coupled to an anchor, and FIG. 2 is an exploded view of the example tubing swivel of FIG. 1. The structure of the example tubing swivel is described below with reference to both FIGS. 1 and 2, and its operation will be described primarily with reference to the subsequent Figures.

It will be apparent that the Figures and the description below concentrate primarily on components of a tubing swivel. Those skilled in the art will be familiar with production wells, tubing strings, and anchors, as well as surface and downhole equipment in conjunction with which a tubing swivel may be used.

As shown in FIGS. 1 and 2, the example tubing swivel 100 includes a top sub 102 to be connected to a tubing string (not shown), which would normally be in a position above the top sub in a production well. The top sub 102 includes, as one possible implementation of an engagement structure, a set of lugs 104 milled out or otherwise formed on what would be its lower end during use in an upright or vertical production well. In the example shown, a circumferential channel or groove 106 is formed in the outer surface of the top sub 102 to receive set screws 172, which are an example of fasteners to attach a housing 170 to the top sub 102. Other structures such as bores could be provided in the top sub 102 to receive the set screws or other fasteners. The top sub 102 also includes an external circumferential shoulder 108, which in the embodiment shown acts as a stop for housing 170.

Circumferential channels or grooves 110, 112, 114 are also provided in the top sub 102 in the example shown, to receive seals 120, 122, 124, respectively.

A mandrel 130, like the top sub 102, also has an engagement structure 132. Grooves 134 are provided in the mandrel 130 to receive shear screws 174, which are an example of shear fasteners to attach the housing 170 to the mandrel 130. In the example shown, the grooves 134 do not communicate with the inside of the mandrel 130. The grooves 134 have an oval shape, and they extend past the end of the housing 170. This can be seen perhaps most clearly in FIG. 1. The inner ends of the shear screws 174 are at one end of the grooves 134, and the other end of the grooves extend beyond the end of the housing 170. When the shear screws 174 are sheared, the oval shape of the grooves 134 and their extension past the end of the housing 170 will allow the portion of each screw that has sheared, to pass along its groove, past the end of the housing, and into the well. Bores 176, 178 in the housing 170 are threaded when shear screws 174 are used, but the grooves 134 are not threaded in an embodiment. The inner ends of the shear screws 174 are received in the grooves 134 and prevent rotation of the housing 170 relative to the mandrel 130 until the shear screws are sheared. This arrangement allows rotation to be applied to the mandrel 130 by the top sub 102 through the housing 170 until the shear screws 174 are sheared, and then the sheared pieces of the shear screws that were received in the grooves 134 can be cleared through the grooves. Clearing of the sheared pieces of the shear screws 174 through the grooves 134 prevents those pieces from getting jammed in-between the mandrel 130 and the housing 170 and blocking the rotation of the swivel 100.

As shown in FIG. 1, the mandrel 130 may be coupled to an anchor 103.

An external circumferential shoulder 136 on the mandrel 130 allows the mandrel to be supported and/or moved in an axial direction by an internal circumferential shoulder 177 of the housing 170. Bearing rings 140 between the shoulders 136, 177 allow the mandrel 130 and the housing 170 to rotate relative to each other.

The example tubing swivel 100 also includes the coupling 150 to engage both the (first) engagement structure of the top sub 102, in this example the lugs 104, and the (second) engagement structure of the mandrel 130 at 132. The coupling 150 has a first coupling structure, in the form of lugs 152 in the example shown, with a shape complementary to a shape of the first engagement structure of the top sub 102. The coupling 150 also has a second coupling structure 154 with a shape complementary to a shape of the second engagement structure of the mandrel 130. A spring 160 bears on an internal circumferential shoulder 116 of the top sub 102 and an internal circumferential shoulder 156 of the coupling 150, to bias the coupling toward the second engagement structure at 132 in this example.

Finally, the housing 170 has bores 176, 178 to receive the set screws 172 and the shear screws 174. An internal circumferential groove or channel 179 in the housing 170 accommodates a further seal 126 in the example shown.

The example tubing swivel 100 could be installed, for example, above a downhole pump. The pump below the tubing swivel 100 and the tubing string above the tubing swivel would be anchored to the production casing in this example with a right hand set tubing tension or torque anchor coupled to the mandrel 130. These types of tubing anchors are set with right hand rotation of the tubing string, which in turn rotates the mandrel 130, and are released with left hand rotation of the tubing string. When a tubing anchor is used, the tubing string is normally working in tension.

To be able to set the tension or torque anchor with right hand rotation, the example tubing swivel 100 has a set of shear screws 174 that will allow sufficient right hand setting torque to be applied to the tubing anchor, through the top sub 102, the housing 170, and the mandrel 130. After the anchor is set, over-torquing the shear screws 174 will shear them and the example tubing swivel 100 will allow the tubing string above it, to be rotated to the right.

The overall structure of the example tubing swivel 100 is relatively simple. The top sub 102 connects at its top to the tubing string above. The housing 170 connects to the top sub 102 and supports the mandrel 130 on the inside shoulder 177 through bearing rings 140. The coupling 150 can travel axially, back and forth between tapered ratcheting shoulders or inclined surfaces at 132 on the mandrel 130 and the lugs 142 milled in the top sub 102 in this example. The coupling 150 is biased towards the tapered ratcheting shoulders 132 in this example by the spring 160.

It should be noted that the coupling 150 travels back and forth in any position of the example swivel 100. This could be up and down when the example swivel 100 is used in an upright production well, but the present disclosure is not in any way restricted to upright or vertical wells. The spring 160 biases the coupling 150 towards the tapered ratcheting shoulders 132 in this example, to maintain contact between the coupling and the tapered ratcheting shoulders, independent of the position of the swivel. Tubing erosion problems may appear mainly in deviated and horizontal wells, for example, and a swivel as disclosed herein could be installed anywhere in such wells, and not only in upright or vertical wells, to allow tubing rotation all the way to a downhole pump attached to the mandrel 130.

The inside seals 120, 124 seal the inside of the example tubing swivel 100 against the inflow of fluids from the tubing, and the outside seals 122, 126 seal the inside of the example tubing swivel 100 against the inflow of wellbore fluids. The set screws 172 secure the connection between the top sub 102 and the housing 170. The shear screws 174 are used to allow for right hand rotation of the mandrel 130 while the tubing anchor is set, and then they are sheared with sufficient right hand torque, to allow the example tubing swivel 100 to swivel freely to the right. The bearing rings 140 allow the housing 170 to rotate relative to the mandrel 130 even if the tubing string is in tension.

The mandrel 130 would be attached to a downhole pump (not shown) during use, and held stationary after the right hand set tubing tension or torque anchor is set in this example. When the top sub 102 is rotated by a tubing rotator installed at a wellhead, for example, the lugs 104 milled or otherwise formed in or on the top sub will engage the matching lugs 152 milled or otherwise formed in or on the coupling 150 in this example, and the coupling will rotate with it.

Figure 3:
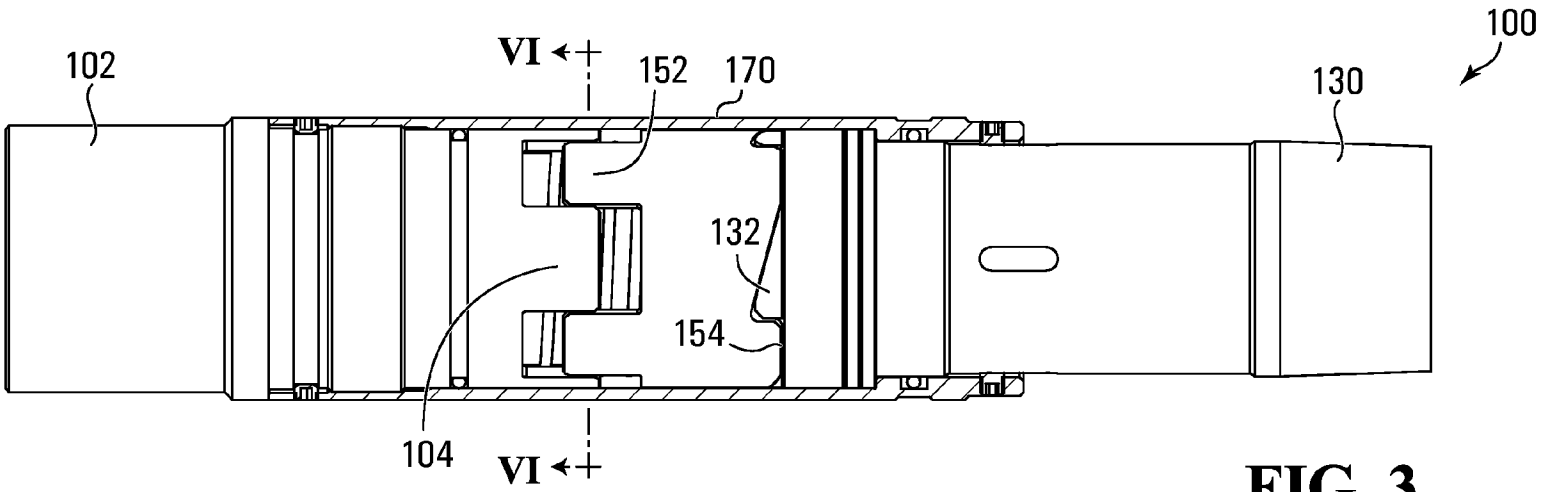
FIGS. 3 to 5 are cross-sectional views of the example tubing swivel of FIG. 1 showing different stages of operation of the tubing swivel.
Figure 4:
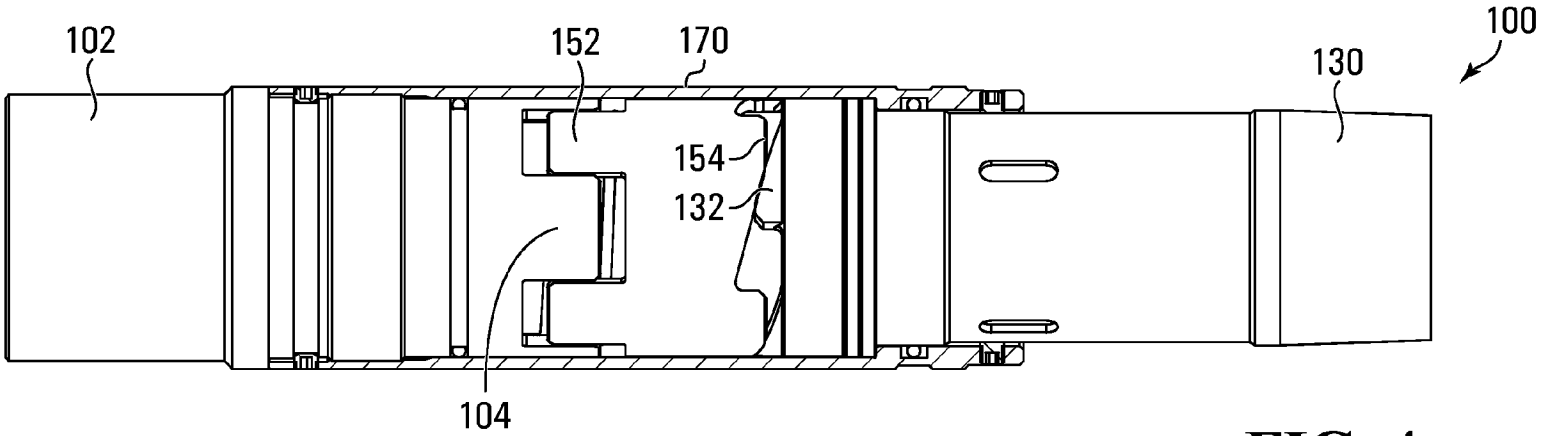
Figure 5:
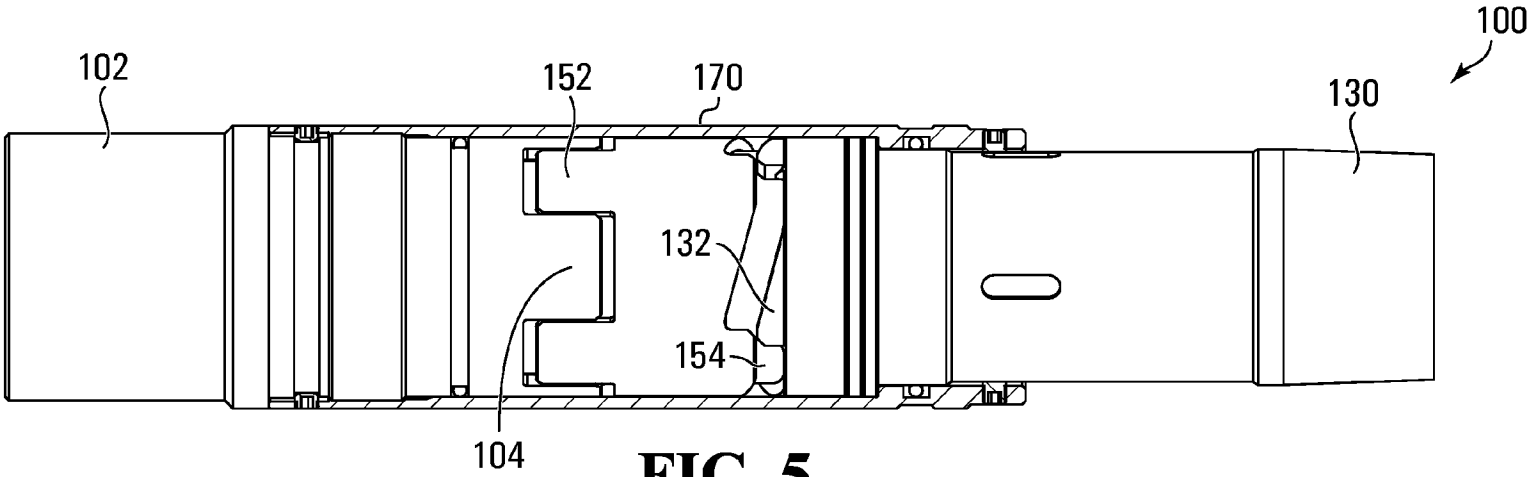

During rotation of the coupling 150, the tapered ratcheting shoulders or inclined surfaces at 154 on the opposite side of the lugs 152 of the coupling 150 will be forced to ride up the matching tapered ratcheting shoulders or inclined surfaces at 132, milled or otherwise formed in or on the mandrel 130. When the tapered (ratchet ramp) shoulders at 154 reach the end (top) of the tapered (ratchet ramp) shoulders at 132 on the mandrel 130, the spring 160 will push the coupling 150 back to the bottom of the shoulders at 132 and the cycle starts again. This is shown perhaps most clearly in FIGS. 3 to 5. In FIG. 3, the shoulders at 154 of the coupling 150 are at the bottom or fully engaged position relative to the shoulders at 132 of the mandrel 130. Right-hand rotation of the tubing string and the top sub 102 moves the coupling 150 to the position shown in FIG. 4, with the shoulders at 154 of the coupling 150 riding along the shoulders at 132 of the mandrel 130. In FIG. 5, the shoulders at 154 of the coupling 150 are at the top of the shoulders at 132 of the mandrel 130, and continued right-hand rotation returns the coupling to the position shown in FIG. 3.

When left hand rotation (torque) is applied to the top sub 102 to release the tubing anchor, the straight (axial) shoulder on the ratcheting side of the coupling 150 at 154 will engage the straight (axial) shoulder on the ratcheting shoulder of the mandrel 130 at 132, and the mandrel 130 will be forced to rotate to the left, to release the anchor. If the anchor is to be set again in a different location, then the tubing string is pulled to the surface for replacement of the shear screws 174.

The process outlined above can be followed as many times as needed to set, release, and reset an anchor.

Figure 6:
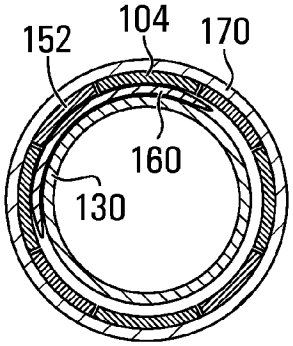
FIG. 6 is a cross-sectional view of the example tubing swivel of FIG. 1 along line VI-VI of FIG. 3.

It should be appreciated that FIGS. 1 to 5, as well as FIG. 6 which is described below, represent one illustrative embodiment. Other embodiments might include fewer, further, or different components interconnected and/or arranged in a similar manner or in a different manner than shown or described. For instance, the engagement and coupling structures on the top sub 102, the mandrel 130, and the coupling 150 could be reversed. The arrangement of the set screws 172 and shear screws 174 could also or instead be reversed. Further variations may be or become apparent.

More generally, a downhole tubing swivel could include a top sub such as 102 for connection to a tubing string of a production well, a mandrel such as 130, a coupling such as 150 to engage both a first engagement structure such as 104 of the top sub and a second engagement structure such as 132 of the mandrel 130, and a housing such as 170 to cover an internal space of the tubing swivel and to couple the top sub to the mandrel. The internal space of the tubing swivel that is covered by the housing 170 in the example shown is between the housing, the top sub 102, and the mandrel 130, and includes the coupling 150. The coupling includes a first coupling structure such as 152 having a shape complementary to a shape of the first engagement structure such as 104, and a second coupling structure such as 154 having a shape complementary to a shape of the second engagement structure such as 132.

Ratcheting between the coupling 150 and the mandrel 130 at 154 and 132 is one example of a clutch mechanism to enable the top sub 102 to be rotated in a first direction relative to the mandrel and to rotate the mandrel with rotation of the top sub in a second direction opposite the first direction. However, as noted above, the engagement and coupling structures on the top sub, the mandrel, and the coupling could be reversed. Therefore, either one of (i) the first engagement structure and the first coupling structure between the top sub and the coupling and (ii) the second engagement structure and the second coupling structure between the mandrel and the coupling, could provide such a clutch mechanism. In the example tubing swivel 100, the clutch mechanism includes a ratchet mechanism, in the form of complementary inclined surfaces at 132, 154. At the other end of the coupling 150, the first engagement structure and the first coupling structure include the complementary lugs 104, 152. Again, it should be appreciated that these structures could be reversed in other embodiments, with the ratchet mechanism between the top sub and the coupling and the lugs between the coupling and the mandrel.

The coupling 150 has a hollow cylindrical body to receive a portion of the mandrel 130. The top sub 102 also has a hollow cylindrical body, and the portion of the mandrel 130 that is received in the coupling 150 is positioned concentrically inside the coupling and the hollow cylindrical body of the top sub. The coupling 150 and the hollow cylindrical body of the top sub 102 are axially adjacent each other along the portion of the mandrel. The concentric arrangement of the mandrel 130 inside the top sub 102 and the coupling 150, all of which are further concentrically arranged inside the housing 170, can perhaps best be appreciated with reference to FIG. 6. The axial arrangement of the top sub 102 and the coupling 150 on the mandrel 130 can be seen, for example, in FIGS. 3 to 5.

Considering again the example tubing swivel 100, with a clutch mechanism in the form of a ratchet mechanism including the second engagement structure 132 and the second coupling structure 154, the hollow cylindrical body of the top sub 102 has a first internal circumferential shoulder 116 and the coupling 150 has a second internal circumferential shoulder 156. The spring 160 is positioned between the first internal circumferential shoulder 116 of the top sub 102 and the second internal circumferential shoulder 156 of the coupling 150, to bias the coupling 150 toward the second engagement structure 132 on the mandrel 130.

In another embodiment, the clutch mechanism could be implemented as a ratchet mechanism in the form of complementary inclined surfaces of the first engagement structure and the first coupling structure, between the top sub and the coupling. The spring 160 could then be positioned between an external circumferential shoulder on the mandrel and an internal circumferential shoulder on the coupling, to bias the coupling toward the first engagement structure on the top sub.

One or more seals, such as the outside seals 122, 126, could be provided to seal the internal space of the tubing swivel from the production well.

In the example tubing swivel 100, there are four set screws 172 to attach the housing 170 to the top sub 102, and four shear screws 174 to attach the housing to the mandrel 130. More generally, a tubing swivel may include one or more fasteners to attach the housing to one of the top sub and the mandrel, and one or more shear fasteners to attach the housing to the other of the top sub and the mandrel. The shear fastener(s) would have lower strength than the fastener(s), to enable rotation of the mandrel with the top sub in the first direction (e.g., right hand rotation) with application of a torque in the first direction up to a shear torque of the shear fastener(s) and to enable the top sub to be rotated in the first direction relative to the mandrel after a torque greater than the shear torque has been applied to the mandrel by the top sub. In this arrangement, the housing 170 couples the top sub 102 to the mandrel 130 through a fixed connection to the top sub at one end of the housing and through a "temporary" fixed connection to the mandrel at the other end of the housing. After shearing of the shear fastener(s), the housing 170 still couples the top sub 102 to the mandrel 130, but the housing is then coupled to the mandrel through a movable (rotatable) connection, through the bearing rings 140.

The shear fastener(s) could attach the housing to the mandrel, as shown in the example tubing swivel 100. In this case, a portion of the mandrel 130 has an external circumferential shoulder 136 and one or more grooves 134 to receive the shear fastener(s). The external circumferential shoulder 136 is axially spaced from the groove(s) along the mandrel 130 in a direction toward the top sub 102, as shown perhaps most clearly in FIG. 2. The housing 170 has a hollow cylindrical body to receive the portion of the mandrel 130, the bearing rings 140, the coupling 150, and a portion of the top sub 102, and the housing also has one or more bores to receive the shear fastener(s) and an internal circumferential shoulder 177 to engage the mandrel between the external circumferential shoulder 136 and the groove(s) 134 in the mandrel. This arrangement allows the internal circumferential shoulder 177 of the housing 170 to support and/or move the mandrel 130 in an axial direction. The bearing rings 140 allow the housing 170 to rotate relative to the mandrel 130 once the shear fastener(s), in this example the shear screws 174, have been over-torqued and sheared. In an embodiment, the grooves 134 extend axially along the mandrel 130 beyond an end of the housing 170 in a direction away from the top sub 102, to provide for clearing of sheared ends of the shear fasteners from between the mandrel and the housing.

A shear fastener and shoulder arrangement could be provided between the housing and the top sub instead of between the housing and the mandrel. In this case, a portion of the top sub could include an external circumferential shoulder and one or more grooves to receive the one or more shear fasteners, with the external circumferential shoulder being axially spaced from the one or more grooves along the top sub in a direction toward the mandrel. An internal circumferential shoulder could then be provided in the housing to engage the top sub, through one or more bearing rings, between the external circumferential shoulder and the groove(s) in the top sub. In this embodiment, there is a fixed connection at one end of the housing, in this case between the housing and the mandrel, and a "temporary" fixed connection at the other end of the housing, between the housing and the top sub. Through these connections, the housing couples the top sub to the mandrel. After shearing of the one or more shear fasteners, the housing still couples the top sub to the mandrel, but through the fixed connection to the mandrel and a movable (rotatable) connection to the top sub. As in embodiments in which the housing is attached to the mandrel using one or more shear fasteners, the grooves in the top sub could extend axially along the top sub beyond an end of the housing 170, in this case in a direction away from the mandrel, to provide for clearing of sheared ends of the shear fasteners from between the top sub and the housing.

There are also other embodiments which enable rotation of the mandrel with the top sub in the first direction until one or more shear fasteners are sheared. For instance, one or more shear fasteners could be used to attach the top sub to the mandrel, and the housing could be attached to either the top sub or the mandrel with one or more fasteners. As in other embodiments, the one or more shear fasteners have lower strength than the one or more fasteners, to enable rotation of the mandrel with the top sub in the first direction with application of a torque in the first direction up to a shear torque of the one or more shear fasteners and to enable the top sub to be rotated in the first direction relative to the mandrel after a torque greater than the shear torque has been applied to the mandrel by the top sub.

The one or more fasteners provide a fixed connection at one end of the housing (to either the top sub or the mandrel). At the other end of the housing, a shoulder/bearing ring arrangement could be provided as in other embodiments. There need not be any fasteners at the end of the housing where the shoulder/bearing arrangement is provided, as the shear fastener(s) between the top sub and the mandrel would provide the "temporary" fixed connection to enable rotation of the mandrel with the top sub until shearing of the shear fastener(s). The housing still couples the top sub to the mandrel through a fixed connection and a rotatable connection, although in this case the rotatable connection need not be temporarily fixed by shear fastener(s) between the housing and the mandrel or between the housing and the top sub.

A tubing swivel with this type of arrangement could be substantially similar in structure to the example tubing swivel 100 in FIG. 1, without the bores 178 in the housing 170, the shear screws 174, or the grooves 134 in the mandrel 130, which would not be needed if the top sub 102 is connected to the mandrel 130 using one or more shear fasteners. The top sub 102 and the mandrel 104 could include one or more bores for receiving the one or more shear fasteners. The bore(s) in the mandrel 130 could be only part way through the mandrel, so as to avoid providing additional seals to seal the interior space of the tubing swivel against the inflow of fluids from the tubing.

One possible option for avoiding additional seals would be to position the shear fastener(s) and bore(s) toward the end of the mandrel 130 from the seal 120, to the left of the seal 120 in the view shown in FIG. 1. The mandrel 130 could be extended in the direction toward the top sub 102, to provide more space for the shear fastener(s) and bore(s).

As described herein, the grooves 134 in the embodiment shown in FIG. 1 provide for clearing of sheared portions of the shear screws 174 from between the housing 170 and the mandrel 130. In embodiments with one or more shear fasteners attaching the top sub 102 to the mandrel 130, bores in the top sub and the mandrel could both be threaded, so that sheared portions of the shear fastener(s) remain in the bores and do not interfere with rotation between the top sub and the mandrel. If the shear fastener(s) and bore(s) are located toward the end of the mandrel 130 relative to the seal 120, then the bore(s) in the mandrel could be unthreaded and entirely through the mandrel. The sheared end(s) of the shear fastener(s) could then exit the bore(s) in the mandrel 130 into the interior of the tubing swivel.

Any bore(s) in the top sub 102 and the mandrel 130 need not necessarily be threaded at all, as once the housing 170 is installed, the housing would prevent the shear fastener(s) from falling out of the top sub bore(s). In this case, shear pins could be used to temporarily connect the top sub 102 to the mandrel 130.

For installation of the shear fastener(s), the shear fastener(s) can be installed after the housing 170 is slid over the mandrel 130 and the top sub 102, in embodiments in which the housing is connected to the mandrel (as shown in FIG. 1) or the housing using the shear fastener(s). Shear fastener(s) between the top sub 102 and the mandrel 130 could be installed before the housing 170 is slid over the top sub and the mandrel. Another possible option would be to provide an access opening such as an unthreaded bore in the housing 170, through which each shear fastener(s) could be installed to attach the top sub 102 to the mandrel 130. Such access openings might be feasible, for example, if they are located on the housing 170 in a direction toward the top sub 102 relative to the seal 122. In the view shown in FIG. 1, this would be to the left of the seal 122. If the bore(s) in the top sub 102 and the mandrel 130 are located toward the end of the mandrel from the seal 120, then in the example shown in FIG. 1 there could be access openings in the housing 170 without interfering with sealing of the internal space of the example tubing swivel 100.

The shear fastener(s) in any of these embodiments can thus enable rotation of the mandrel with the top sub in the first direction, to set an anchor that is coupled to the mandrel for example, and the clutch mechanism enables the top sub to rotate the mandrel with rotation of the top sub in the second direction, to release the anchor.

Such a tubing swivel could be used in conjunction with other equipment of a production well completion system. The production well completion system could include, for example, the tubing string connected to the top sub, and downhole equipment that includes an anchor coupled to the mandrel.

FIGS. 1 to 6 and the description thereof relate to apparatus embodiments. Related methods are also contemplated.

Figure 7:
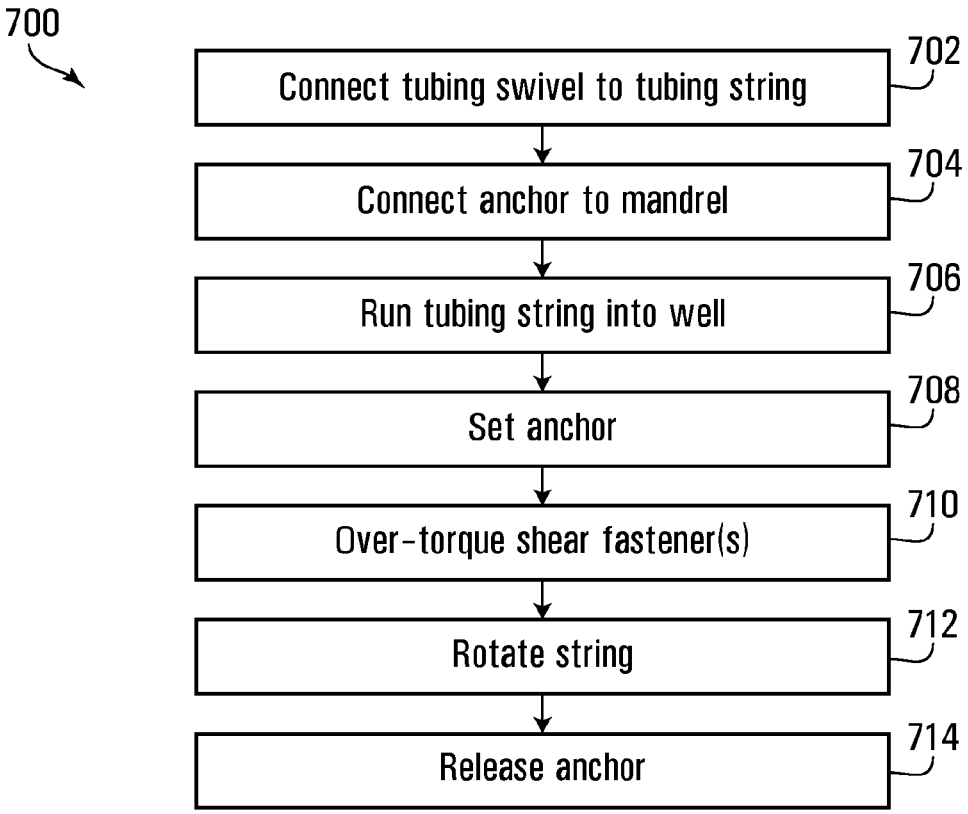
FIG. 7 is a flow diagram illustrating an example method of operating a tubing swivel.

FIG. 7 is a flow diagram illustrating an example method of operating a tubing swivel. The example method 700 includes connecting a tubing swivel to a tubing string of a production well at 702. The tubing swivel includes a top sub, a mandrel, a coupling, and a housing as disclosed herein. An anchor is connected to the mandrel at 704. The example method 700 also involves running the tubing string into the production well at 706, and setting the anchor at a downhole position in the production well at 708 by rotating the tubing string in the first direction to rotate the top sub, the housing, and the mandrel. Over-torquing the shear fastener(s) at 710 involves applying a torque greater than a shear torque of the shear fastener(s) in the first direction to shear the shear fastener(s). This allows the top sub to be rotated in the first direction relative to the mandrel at 712. At 714, the tubing string is rotated in the second direction to release the anchor.

Variations of the example method 700 may be or become apparent. For example, the mandrel might first be connected to the anchor and then the tubing swivel top sub could be connected to the tubing string, reversing the operations shown at 702, 704. A method could also include additional operations, such as retracting the tubing string to a surface of the production well, replacing the shear fastener(s) to again attach the housing to the top sub or the mandrel, running the tubing string into the production well, and rotating the tubing string in the first direction to rotate the top sub, the housing, and the mandrel to set the anchor at a new downhole position in the production well.

Figure 8:
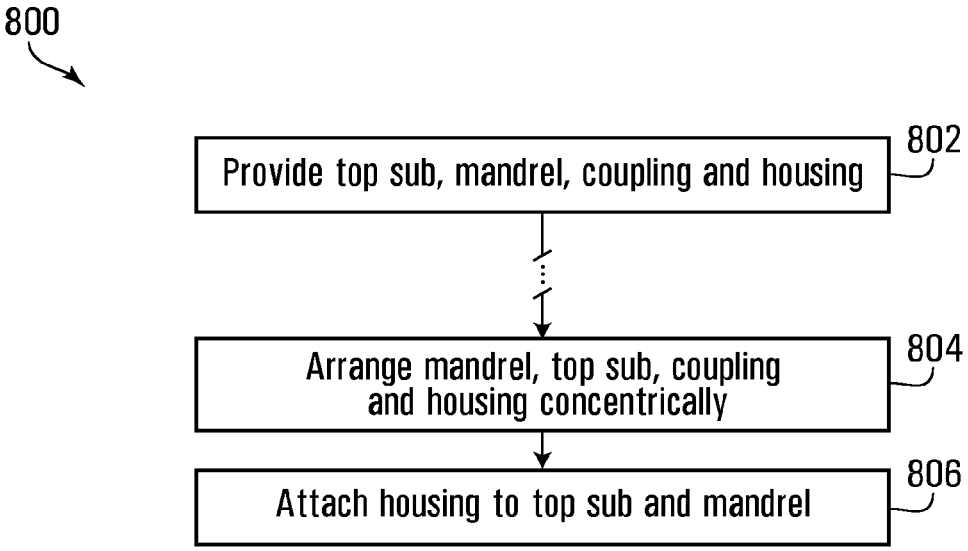
FIG. 8 is a flow diagram illustrating an example method of manufacturing and assembling a tubing swivel.

As an example of another type of related method, FIG. 8 is a flow diagram illustrating an example method of manufacturing and assembling a tubing swivel. The example method 800 involves providing a top sub, a mandrel, a coupling, and a housing at 802. These components are as described herein. Providing these components could involve manufacturing the components, or providing the components such as by purchasing or otherwise obtaining them.

The example method 800 also involves arranging the mandrel, the coupling, the top sub, and the housing concentrically, at 804. The broken arrow between 802 and 804 is intended to indicate that the providing at 802 and the arranging at 804 need not be performed in direct sequence in time, but rather the arranging at 804 and subsequent operations could be performed some time later, at a different site, and/or possibly by different entities.

The arranging at 804 involves arranging a portion of the mandrel inside the coupling and a portion of the top sub, with the coupling and the top sub axially adjacent each other along the portion of the mandrel and the housing outside the top sub, the mandrel, and the coupling. An example of the concentric arrangement of components can perhaps best be seen in FIG. 6, and an example of the axial arrangement of the top sub and the coupling on the mandrel is shown, for example, in FIGS. 3 to 5. In an embodiment, with reference now to FIGS. 1 and 2, the mandrel 130 is slid through the housing 170 in a direction from left to right in the drawings, the coupling 150 is slid onto the mandrel again from left to right, the spring 160 is slid onto the mandrel and partially into the coupling, and the top sub 102 is slid onto the mandrel and partially over the spring.

With reference now to FIG. 8, at 806 the housing is attached to the top sub and the mandrel. The present disclosure is not limited to any particular order of attachment for the housing. The housing is first attached to either the top sub or the mandrel with one or more fasteners, and is then attached to the other of the top sub and the mandrel with one or more shear fasteners in some embodiments. In the example tubing swivel 100, before attachment of the housing 170 to both the top sub 102 and the mandrel 130 is completed, the top sub could be moved axially along the mandrel to compress the spring 160 so that the coupling 150 is biased toward the mandrel.

Other operations that could be involved in manufacturing or assembling a tubing swivel include providing and installing other components, such as the bearing rings 140 between the shoulders 136, 177 (FIG. 1) or cooperating shoulders on the housing 170 and the top sub 102 in another embodiment, one or more seals such as the seal 122 to seal the housing against the top sub, one or more seals such as the seal 126 to seal the housing against the mandrel, and/or one or more seals such as the seals 120, 124 to seal the top sub against the mandrel.

These components could be installed during assembly, while installation locations are accessible. The seal 126 could be installed into the circumferential groove or channel 179 in the housing 170 before the mandrel 130 is slid into the housing. The bearing rings 140 could also be positioned on the shoulder 177 or on the mandrel 130 before the mandrel 130 is slid into the housing 170. The other seals 120, 122, 124 could all be installed into their channels or grooves 110, 112, 114 in the top sub 122 before the top sub 102 is slid onto the mandrel 130.

Similarly, in embodiments in which the top sub is connected to the mandrel using one or more shear fastener(s), the shear fastener(s) could be installed while the corresponding bore locations are accessible. This could be before the housing is put into its final position for attachment to the top sub or the housing. If the housing has one or more access openings to provide access to the bore locations, then the shear fastener(s) could instead be installed after the housing is already in place.

What has been described is merely illustrative of the application of principles of embodiments of the present disclosure. Other arrangements and methods can be implemented by those skilled in the art.

For example, various structural arrangements shown in FIGS. 1 to 6 could be reversed. Reversal of the positions of the clutch mechanism and the shear fastener/shoulder arrangements are noted above. Channels or groove positions for accommodating seals could similarly be reversed. The channel or groove 110 (FIG. 1), for instance, could be formed in the mandrel 130 instead of in the top sub 102.

The spring 160 in the example tubing swivel 100 is arranged concentrically around the mandrel 130 and partially inside the top sub 102 and the coupling 150. In another embodiment, the spring could be arranged outside the top sub 102 and the coupling 150 and inside the housing.

Numbers and types of components shown in the drawings and described herein are also intended for illustrative purposes. Other types and/or numbers of components could be used in other embodiments.

Embodiments could also include components or features that are not explicitly shown in the drawings. For instance, the top sub and the housing could be threaded, so that the top sub and the housing are coupled together not only by one or more fasteners, but also through a threaded connection as well. During assembly, the housing could be threaded onto the top sub, and the one or more fastener(s) could then be set screws to secure the housing against rotation that would unscrew it from the top sub and release the threaded connection.

What is claimed is:

1. A downhole tubing swivel comprising:

a top sub for connection to a tubing string of a production well, the top sub comprising a first engagement structure;

a mandrel comprising a second engagement structure;

a coupling to engage both the first engagement structure and the second engagement structure;

a housing to cover an internal space of the tubing swivel, between the housing, the top sub, and the mandrel and including the coupling, and to couple the top sub to the mandrel, the coupling comprising a first coupling structure having a shape complementary to a shape of the first engagement structure and a second coupling structure having a shape complementary to a shape of the second engagement structure, one of (i) the first engagement structure and the first coupling structure and (ii) the second engagement structure and the second coupling structure comprising a clutch mechanism to enable the top sub to be rotated in a first direction relative to the mandrel and to rotate the mandrel with rotation of the top sub in a second direction opposite the first direction, wherein the housing is attached to one of the top sub and the mandrel;

wherein the tubing swivel further comprises one or more shear fasteners to attach the housing to the other of the top sub and the mandrel, to enable rotation of the mandrel with the top sub in the first direction with application of a torque in the first direction up to a shear torque of the one or more shear fasteners and to enable the top sub to be rotated in the first direction relative to the mandrel after a torque greater than the shear torque has been applied to the mandrel by the top sub.

2. The tubing swivel of claim 1, the clutch mechanism comprising a ratchet mechanism, the ratchet mechanism comprising complementary inclined surfaces of the one of (i) the first engagement structure and the first coupling structure and (ii) the second engagement structure and the second coupling structure.

3. The tubing swivel of claim 1, the other of (i) the first engagement structure and the first coupling structure and (ii) the second engagement structure and the second coupling structure comprising complementary lugs.

4. The tubing swivel of claim 1, the coupling comprising a hollow cylindrical body to receive a portion of the mandrel.

5. The tubing swivel of claim 4, the top sub comprising a hollow cylindrical body, the portion of the mandrel being positioned concentrically inside the coupling and the hollow cylindrical body of the top sub, and the coupling and the hollow cylindrical body of the top sub being axially adjacent each other along the portion of the mandrel.

6. The tubing swivel of claim 5, the clutch mechanism comprising a ratchet mechanism, the ratchet mechanism comprising complementary inclined surfaces of the second engagement structure and the second coupling structure, the hollow cylindrical body of the top sub comprising a first internal circumferential shoulder, the coupling comprising a second internal circumferential shoulder, the tubing swivel further comprising:

a spring between the first internal circumferential shoulder of the top sub and the second internal circumferential shoulder of the coupling, to bias the coupling toward the second engagement structure.

7. The tubing swivel of claim 5, the clutch mechanism comprising a ratchet mechanism, the ratchet mechanism comprising complementary inclined surfaces of the first engagement structure and the first coupling structure, the mandrel comprising an external circumferential shoulder, the coupling comprising an internal circumferential shoulder, the tubing swivel further comprising:

a spring between the external circumferential shoulder of the mandrel and the internal circumferential shoulder of the coupling, to bias the coupling toward the first engagement structure.

8. The tubing swivel of claim 1, further comprising:

seals to seal the internal space of the tubing swivel from the production well.

9. The tubing swivel of claim 1, further comprising:

one or more fasteners to attach the housing to one of the top sub and the mandrel, the one or more shear fasteners having lower strength than the one or more fasteners.

10. The tubing swivel of claim 9, a portion of the mandrel comprising an external circumferential shoulder and one or more grooves to receive the one or more shear fasteners, the external circumferential shoulder being axially spaced from the one or more grooves along the mandrel in a direction toward the top sub, the housing comprising a hollow cylindrical body to receive the portion of the mandrel, the coupling, and a portion of the top sub, the housing further comprising one or more bores to receive the one or more shear fasteners, and an internal circumferential shoulder to engage the mandrel between the external circumferential shoulder and the one or more grooves in the mandrel.

11. The tubing swivel of claim 10, the grooves extending axially along the mandrel beyond an end of the housing in a direction away from the top sub.

12. The tubing swivel of claim 9, a portion of the top sub comprising an external circumferential shoulder and one or more grooves to receive the one or more shear fasteners, the external circumferential shoulder being axially spaced from the one or more grooves along the top sub in a direction toward the mandrel, the housing comprising a hollow cylindrical body to receive a portion of the mandrel, the coupling, and the portion of the top sub, the housing further comprising one or more bores to receive the one or more shear fasteners, and an internal circumferential shoulder to engage the top sub between the external circumferential shoulder and the one or more grooves in the top sub.

13. The tubing swivel of claim 12, the grooves extending axially along the top sub beyond an end of the housing in a direction away from the mandrel.

14. The tubing swivel of claim 9, the one or more shear fasteners enabling rotation of the mandrel with the top sub in the first direction to set an anchor coupled to the mandrel, the clutch mechanism enabling the top sub to rotate the mandrel with rotation of the top sub in the second direction to release the anchor.

15. The tubing swivel of claim 1, implemented in a production well completion system, the production well completion system further comprising:

the tubing string connected to the top sub; and downhole equipment comprising an anchor coupled to the mandrel.

16. A downhole tubing swivel, comprising:

a top sub for connection to a tubing string of a production well, the top sub comprising a first engagement structure;

a mandrel comprising a second engagement structure;

a coupling to engage both the first engagement structure and the second engagement structure;

a housing to cover an internal space of the tubing swivel, between the housing, the top sub, and the mandrel and including the coupling, and to couple the top sub to the mandrel;

one or more fasteners to attach the housing to one of the top sub and the mandrel;

one or more shear fasteners to attach the top sub to the mandrel, the one or more shear fasteners having lower strength than the one or more fasteners, to enable rotation of the mandrel with the top sub in the first direction with application of a torque in the first direction up to a shear torque of the one or more shear fasteners and to enable the top sub to be rotated in the first direction relative to the mandrel after a torque greater than the shear torque has been applied to the mandrel by the top sub, the coupling comprising a first coupling structure having a shape complementary to a shape of the first engagement structure and a second coupling structure having a shape complementary to a shape of the second engagement structure, one of (i) the first engagement structure and the first coupling structure and (ii) the second engagement structure and the second coupling structure comprising a clutch mechanism to enable the top sub to be rotated in a first direction relative to the mandrel and to rotate the mandrel with rotation of the top sub in a second direction opposite the first direction.

17. A method comprising:

connecting a tubing swivel to a tubing string of a production well, the tubing swivel comprising a top sub for connection to the tubing string and comprising a first engagement structure, a mandrel comprising a second engagement structure, a coupling, and a housing attached to one of the top sub and the mandrel by one or more fasteners and attached to the other of the top sub and the mandrel by one or more shear fasteners, the coupling to engage both the first engagement structure and the second engagement structure, the coupling comprising a first coupling structure having a shape complementary to a shape of the first engagement structure and a second coupling structure having a shape complementary to a shape of the second engagement structure, one of (i) the first engagement structure and the first coupling structure and (ii) the second engagement structure and the second coupling structure comprising a clutch mechanism to enable the top sub to be rotated in a first direction relative to the mandrel and to rotate the mandrel with rotation of the top sub in a second direction opposite the first direction;

connecting an anchor to the mandrel;

running the tubing string into the production well;

rotating the tubing string in the first direction to rotate the top sub, the housing, and the mandrel to set the anchor at a downhole position in the production well;

applying a torque greater than a shear torque of the one or more shear fasteners in the first direction to shear the one or more shear fasteners and allow the top sub to be rotated in the first direction relative to the mandrel;

rotating the tubing string in the second direction to release the anchor.

18. The method of claim 17, further comprising:

retracting the tubing string to a surface of the production well;

replacing the one or more shear fasteners to attach the housing to the other of the top sub and the mandrel;

running the tubing string into the production well; and rotating the tubing string in the first direction to rotate the top sub, the housing, and the mandrel to set the anchor at a new downhole position in the production well.

19. The method of claim 17, further comprising one or more of:

installing one or more seals to seal the housing against the top sub;

installing one or more seals to seal the housing against the mandrel;

installing one or more seals to seal the top sub against the mandrel.

20. A method comprising:

providing a top sub for connection to a tubing string of a production well, the top sub comprising a first engagement structure;

providing a mandrel comprising a second engagement structure;

providing a coupling to engage both the first engagement structure and the second engagement structure;

providing a housing to cover an internal space of a tubing swivel, between the housing, the top sub, and the mandrel and including the coupling, and to couple the top sub to the mandrel, the coupling comprising a first coupling structure having a shape complementary to a shape of the first engagement structure and a second coupling structure having a shape complementary to a shape of the second engagement structure, one of (i) the first engagement structure and the first coupling structure and (ii) the second engagement structure and the second coupling structure comprising a clutch mechanism to enable the top sub to be rotated in a first direction relative to the mandrel and to rotate the mandrel with rotation of the top sub in a second direction opposite the first direction, the method further comprising:

attaching the housing to one of (a) the top sub and (b) the mandrel;

attaching the housing to the other of (a) the top sub and (b) the mandrel with one or more shear fasteners, to enable rotation of the mandrel with the top sub in the first direction with application of a torque in the first direction up to a shear torque of the one or more shear fasteners and to enable the top sub to be rotated in the first direction relative to the mandrel after a torque greater than the shear torque has been applied to the mandrel by the top sub.

21. The method of claim 20, further comprising:

arranging the mandrel, the coupling, the top sub, and the housing concentrically, with a portion of the mandrel inside the coupling and a portion of the top sub, with the coupling and the top sub axially adjacent each other along the portion of the mandrel, and with the housing outside the top sub, the mandrel, and the coupling, attaching the housing to one of (a) the top sub and (b) the mandrel comprising attaching the housing to the one of the top sub and the mandrel with one or more fasteners, the one or more shear fasteners having lower strength than the one or more fasteners.

22. The method of claim 20, further comprising one or more of:

installing one or more seals to seal the housing against the top sub;

installing one or more seals to seal the housing against the mandrel;

installing one or more seals to seal the top sub against the mandrel.

* * * * *